US009224352B2

(12) United States Patent
Watanabe et al.

(10) Patent No.: US 9,224,352 B2
(45) Date of Patent: Dec. 29, 2015

(54) DISPLAY DEVICE WITH DE-MULTIPLEXERS HAVING DIFFERENT DE-MULTIPLEX RATIOS

(71) Applicant: Innolux Corporation, Chu-Nan (TW)

(72) Inventors: Hidetoshi Watanabe, Chu-Nan (TW); Yoshitada Ozaki, Chu-Nan (TW)

(73) Assignee: INNOLUX CORPORATION, Chu-Nan (TW)

( * ) Notice: Subject to any disclaimer, the term of this patent is extended or adjusted under 35 U.S.C. 154(b) by 171 days.

(21) Appl. No.: 14/156,233

(22) Filed: Jan. 15, 2014

(65) Prior Publication Data

US 2015/0199936 A1 Jul. 16, 2015

(51) Int. Cl.
*G09G 3/36* (2006.01)

(52) U.S. Cl.
CPC ..... *G09G 3/3685* (2013.01); *G09G 2310/0297* (2013.01)

(58) Field of Classification Search
CPC ..... G09G 3/3685; G09G 2310/0297
See application file for complete search history.

(56) References Cited

U.S. PATENT DOCUMENTS

| | | | | |
|---|---|---|---|---|
| 7,190,337 | B2 * | 3/2007 | Miller et al. | 345/87 |
| 8,432,335 | B2 * | 4/2013 | Kim | 345/76 |
| 8,797,238 | B2 * | 8/2014 | Kwak et al. | 345/76 |
| 2005/0001797 | A1 * | 1/2005 | Miller et al. | 345/87 |
| 2006/0267885 | A1 * | 11/2006 | Kwak et al. | 345/76 |
| 2006/0274570 | A1 * | 12/2006 | Jeoung et al. | 365/154 |
| 2007/0242016 | A1 * | 10/2007 | Choi | 345/92 |
| 2010/0085293 | A1 * | 4/2010 | Lee et al. | 345/94 |
| 2011/0108844 | A1 * | 5/2011 | Kwak et al. | 257/71 |
| 2011/0164015 | A1 * | 7/2011 | Kim | 345/211 |
| 2014/0203262 | A1 * | 7/2014 | Kwak et al. | 257/40 |
| 2015/0061983 | A1 * | 3/2015 | Kim | 345/82 |

* cited by examiner

*Primary Examiner* — Lun-Yi Lao
*Assistant Examiner* — Peter D McLoone
(74) *Attorney, Agent, or Firm* — Rabin & Berdo, P.C.

(57) ABSTRACT

A display device comprises a display area, a plurality of data buses located in the display area, a controller, a first de-multiplexer, and a second de-multiplexer. The controller is adapted to provide a first data signal and a second data signal. The first de-multiplexer has a first de-multiplexer ratio, and is adapted to output the first data signal received from the controller to a plurality of first data buses of the data buses. The second de-multiplexer has a second de-multiplexer ratio, and is adapted to output the second data signal received from the controller to a plurality of second data buses of the data buses. The first de-multiplexer ratio is different from the second de-multiplexer ratio.

20 Claims, 13 Drawing Sheets

DISPLAY DEVICE WITH DE-MULTIPLEXERS HAVING DIFFERENT DE-MULTIPLEX RATIOS

TECHNICAL FIELD

The disclosure relates in general to a display device with de-multiplexers, and more particularly to a display device with de-multiplexers having different de-multiplex ratios.

BACKGROUND

Recently, display devices such as liquid crystal displays (LCD) and organic light-Emitting diode (OLED) displays are commonly used in portable computer systems, televisions and other electronic devices. Conventionally, de-multiplexers with the same de-multiplexer ratio are applied in some kinds of display devices (ex. LED, OLED) to reduce the output number of the driver integrated circuit (IC). However, this conventional design is still not enough to reduce the output number of the driver IC, and is hard to meet the recent display demand of narrow-border area.

Therefore, there a need for a display device that is capable of significantly reducing the output number of the driver IC, and can meet the recent display demand of narrow-border area.

SUMMARY

The disclosure is directed to a display device with de-multiplexers having different de-multiplex ratios. The display device significantly reduces the output number of the driver IC, and can meet the recent display demand of narrow-border area.

According to an aspect of the present invention, a display device is provided. The display device comprises a display area, a plurality of data buses located in the display area, a controller, a first de-multiplexer, and a second de-multiplexer. The controller is adapted to provide a first data signal and a second data signal. The first de-multiplexer has a first de-multiplex ratio, and is adapted to output the first data signal received from the controller to a plurality of first data buses of the data buses. The second de-multiplexer has a second de-multiplex ratio, and is adapted to output the second data signal received from the controller to a plurality of second data buses of the data buses. The first de-multiplex ratio is different from the second de-multiplex ratio.

Figure 1:
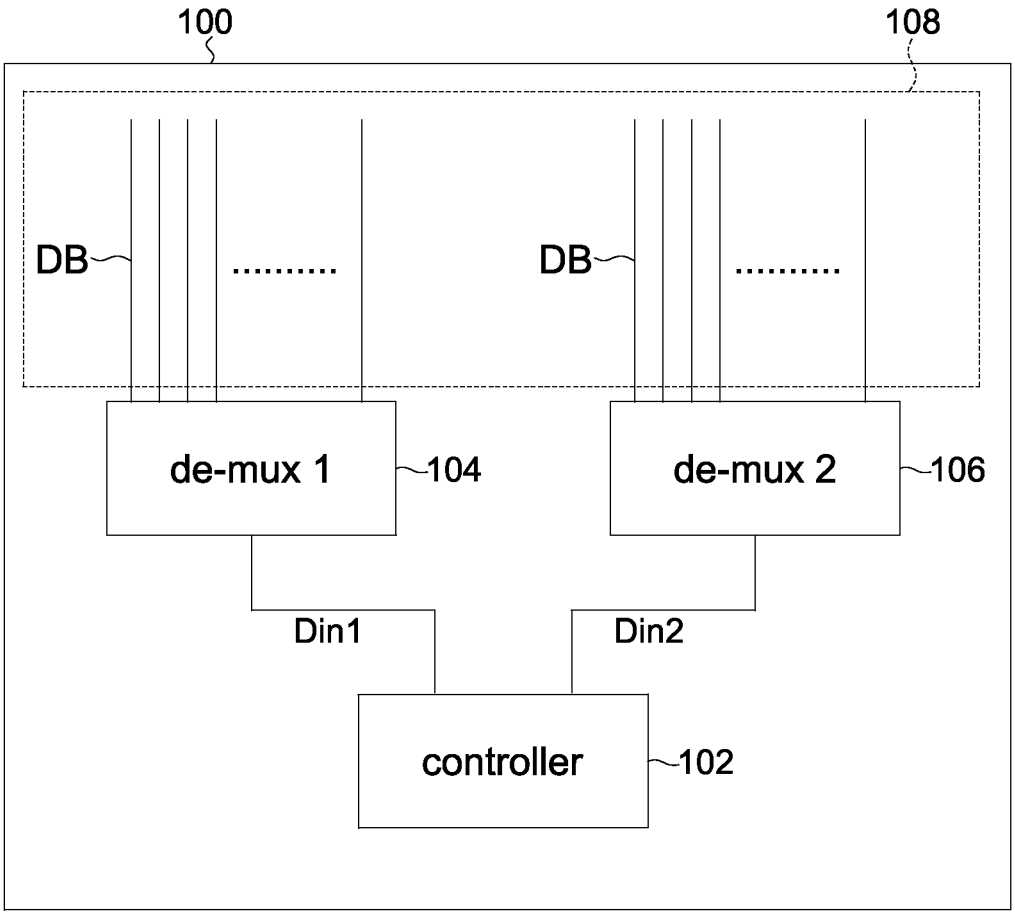
FIG. 1 is a simplified block diagram of a display device according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Below, exemplary embodiments will be described in detail with reference to accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

Referring to FIG. 1, a simplified block diagram of a display device 100 according to an embodiment of the invention is illustrated. The display device 100 comprises a plurality of data buses DB, a controller 102, a first de-multiplexer 104, a second de-multiplexer 106 and a display area 108. The data buses DB are located in the display area 108. Each data bus DB may include, for example, a plurality of pixels (not shown) for displaying images. For example, the pixels may include liquid crystal capacitors and thin film transistors (TFTs). A gate driver IC (not shown) may be coupled to the pixels through gate lines for switching the TFTs, so that data signals can be supplied to the liquid crystal capacitors of the pixels from the data buses DB.

The controller 102 is adapted to provide a first data signal Din1 and a second data signal Din2. For example, the controller 102 may be a data driver IC for supplying data signals to the data buses DB to display images.

The first de-multiplexer 104 has a first de-multiplex ratio, and is adapted to output the first data signal Din1 received from the controller 102 to a plurality of data buses DB. Taking the first de-multiplexer 104 being a 1 to 9 de-multiplexer for example, the first de-multiplexer ratio of the first de-multiplexer 104 is 9. In such situation, the first de-multiplexer 104 has only one input terminal coupled to the controller 102, and has 9 output terminals that each is coupled to a corresponding data bus DB.

The second de-multiplexer 106 has a second de-multiplex ratio, and is adapted to output the second data signal Din2 received from the controller 102 to a plurality of data buses DB. Taking the second de-multiplexer 106 being a 1 to 3 de-multiplexer for example, the second de-multiplex ratio of the second de-multiplexer 106 is 3. In such situation, the second de-multiplexer 106 has only one input terminal coupled to the controller 102, and has 3 output terminals that each is coupled to a corresponding data bus DB.

In the present embodiment, the first de-multiplex ratio of the first de-multiplexer 104 is different from the second de-multiplex ratio of the second de-multiplexer 106. The first and second de-multiplexers 104 and 106 can be appropriately applied in the display device 100 according to, for example, the data bus load of the data buses DB and/or the resistance between the controller 102 and the first and second de-multiplexers 104 and 106, so that the output number of controller 102 can be significantly reduced.

Figure 2:
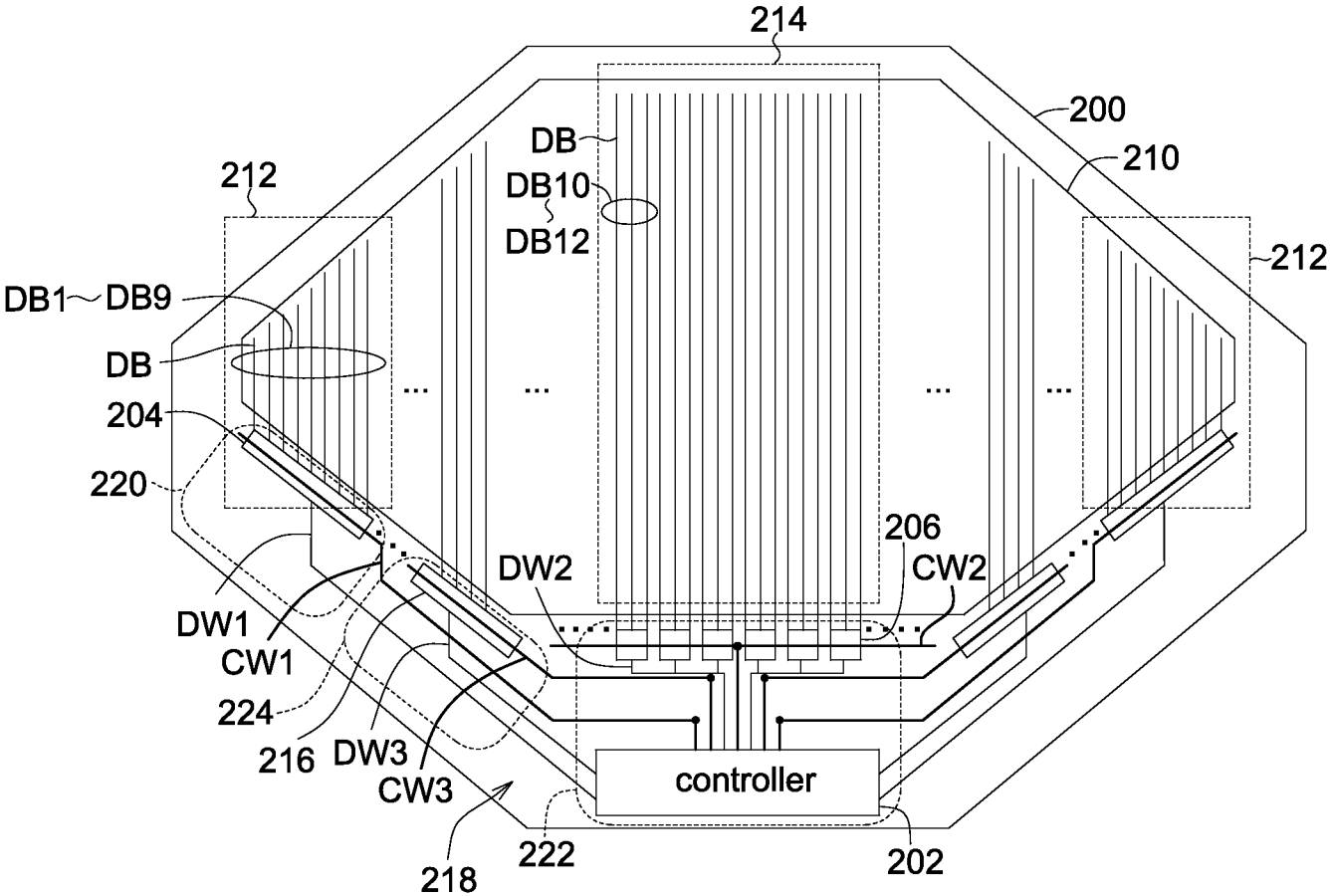
FIG. 2 is a schematic diagram of a display device according to an embodiment of the invention.

FIG. 2 is a schematic diagram of a display device 200 according to an embodiment of the invention. The display device 200 comprises a display area 210, a plurality of data buses DB located in the display area 210, a controller 202, a first de-multiplexer 204, and a second de-multiplexer 206. The first and second de-multiplexers 204 and 206 comprise M and N output terminals, respectively, where M and N are integers larger than 1, and N is less than M. As shown in FIG. 2, the first de-multiplexer 204 comprises 9 output terminals that are respectively coupled to data buses DB1-DB9, and the second de-multiplexer 206 comprises 3 output terminals that are respectively coupled to data buses DB10-DB12. Thus, in this example, the first de-multiplex ratio of the first de-multiplexer 204 is larger than the second de-multiplex ratio of the second de-multiplexer 206.

The controller 202 supplies clock signals to the first and second de-multiplexers 204, 206 through the clock wirings CW1, CW2 to control the first and second de-multiplexers 204 and 206, respectively, and provides the first and second data signals Din1 and Din2 to the first and second de-multiplexers 204, 206 through the first and second data wirings DW1 and DW2, respectively. In this example, the clock wirings CW1 connected to the first de-multiplexer 204 are independent of and different from the clock wirings CW2 connected to the second de-multiplexer 206.

As shown in FIG. 2, the display area 210 is in a shape of octagon. The display area 210 comprises side edge areas 212 and a middle area 214. Generally, the data bus load of a data bus DB is proportional its length (depends on the number of pixels comprised in the data bus DB, for example). Accordingly, the data bus loads of the data buses DB (such as data buses DB1-DB9) located in the side edge areas 212 are smaller than the data bus loads of the data buses DB (such as data buses DB10-DB12) located in the middle area 214. In this example, the first and second de-multiplexers 204 and 206 are appropriately applied in the display device 200 according to the data bus loads of the data buses DB. In other words, de-multiplexers with larger de-multiplex ratio are applied to the data buses DB having smaller data bus load, while de-multiplexers with smaller de-multiplex ratio are applied to the data buses DB having larger data bus load. Thus, in FIG. 2, the first de-multiplexer 204 with larger de-multiplex ratio is applied to the data buses DB1-DB9 located in the side edge areas 212, and the second de-multiplexer 206 with smaller de-multiplex ratio is applied to the data buses DB10-DB12 located in the middle area 214. By the above configuration, the output number of the controller 202 for the side edge areas 212 can be reduced to ⅓ compared to a conventional display device that all de-multiplexers have the same de-multiplex ratio of 3.

It can be understood that the invention is not limited to the above example. The display area 210 can be formed in a shape consisting of circle, shell, semicircle, oval, triangle, rhombus, trapezoid, polygon, and any combinations thereof, as long as the de-multiplexers with larger de-multiplex ratio are applied to the data buses DB having smaller data bus load, while de-multiplexers with smaller de-multiplex ratio are applied to the data buses DB having larger data bus load.

The un-uniformity might be seen at the boundary between the display area 210 of the first de-multiplexer 204 and the display area 210 of the second de-multiplexer 206 because of the dramatic change of the de-multiplex ratio from 9 to 3. Therefore, several de-multiplexers having de-multiplex ratios between the first and second de-multiplex ratios may be provided as a buffer at the boundary between the first and second de-multiplexers 204, 206 to make the un-uniformity unapparent, In an example, the display device 200 may further comprises a third de-multiplexer 216 for outputting a third data signal Din3 received from the controller 202 through the third data wirings DW3 to a third data bus of the data buses DB. The third de-multiplexer 216 may have a third de-multiplex ratio which is larger than the second de-multiplex ratio and smaller than the first de-multiplex ratio. In other examples, the display device 200 may further comprise a fourth de-multiplexer, fifth de-multiplexer, sixth de-multiplexer, etc. at the boundary between the first and second de-multiplexer 204, 206.

Moreover, the display device 200 may further comprise a border area 218 adjacent to the display area 210. The border area 218 is divided into a side edge area 220 for disposing the first de-multiplexer 204, a middle area 222 for disposing the second de-multiplexer 206, and an intermediate area 224 for disposing a de-multiplexer combination of the first and second de-multiplexers 204, 206. The intermediate area 224 is located between the middle area 222 and the side edge area 220. In this example, the de-multiplexer combination comprises a first de-multiplexer combination having a first combination ratio and a second multiplexer combination having a second combination ratio. The first de-multiplexer combination is disposed between the second de-multiplexer combination and the first de-multiplexers 204. The combination ratio is the quantity of the first de-multiplexer to the quantity of the second de-multiplexer. And the first combination ratio is larger than the second combination ratio. In other embodiments, the combination ratio in the intermediate area 224 is increasing from an area adjacent to the middle area 222 to another area adjacent to the side edge area 220.

Figure 3:
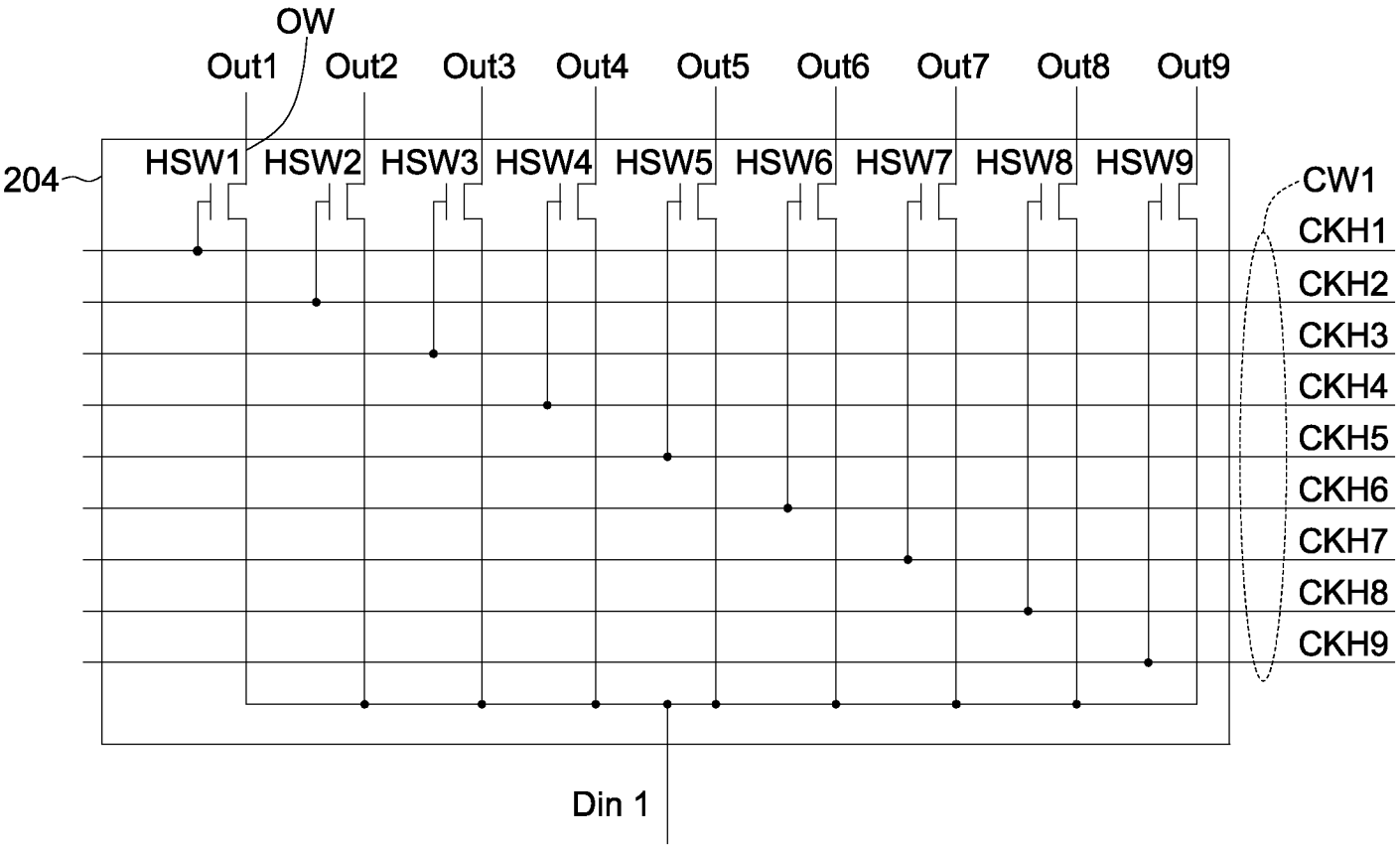
FIG. 3 is a circuit diagram of the first de-multiplexer.

FIG. 3 illustrates a circuit diagram of the first de-multiplexer 204. The first de-multiplexer 204 comprises M switching elements that each having an output wiring OW, where M is an integer. As shown in FIG. 3, the first de-multiplexer 204 comprises switching elements HSW1-HSW9 that each having an output wiring OW. The switching elements HSW1-HSW9, for example, can be implemented with n-channel field effect transistors (p-channel and complementary are also available). The output wirings OW of the switching elements HSW1-HSW9 are respectively coupled to the output terminals Out1-Out9. In this example, the output terminals Out1-Out9 of the first de-multiplexer 204 are respectively coupled to the data buses DB1-DB9. It should be noted that the switching elements can be NMOS, PMOS, or CMOS. The invention proposes the NMOS as an exemplary embodiment.

By providing i clock signals to the first de-multiplexer 204 through i clock wirings CW1, the controller 202 may select one of the output terminals of the first de-multiplexer 204 to output the first data signal Din1, where i is an integer larger than 1. As shown in FIG. 3, the controller 202 provides clock signals CKH1-CKH9 to the first de-multiplexer 204 through 9 clock wirings CW1 to select one of the output terminals Out1-Out9 to output the first data signal Din1 to the data buses DB1-DB9.

Figure 4:
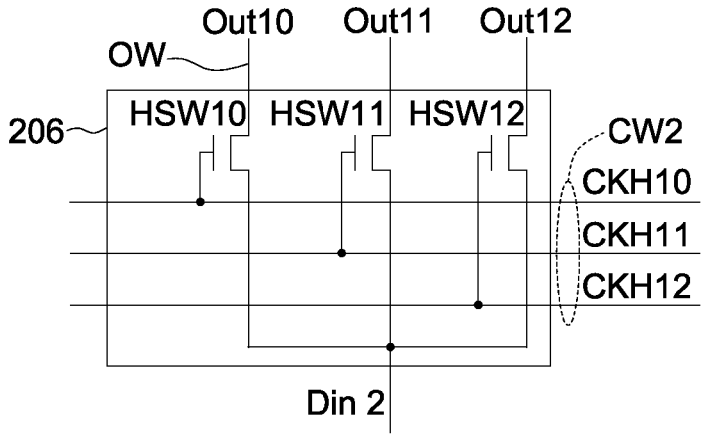
FIG. 4 is a circuit diagram of the second de-multiplexer.

FIG. 4 illustrates a circuit diagram of the second de-multiplexer 206. The second de-multiplexer comprises N switching elements that each having an output wiring OW, where N is an integer less then M. As shown in FIG. 4, the second de-multiplexer comprises switching elements HSW10-HSW12 that each having an output wiring OW. The switching elements HSW10-HSW12, for example, can be implemented with n-channel field effect transistors (p-channel and complementary are also available.). The output wirings OW of the switching elements HSW10-HSW12 are respectively coupled to the output terminals Out10-Out12. In this example, the output terminals Out10-Out12 of the second de-multiplexer 206 are respectively coupled to the data buses DB10-DB12.

By providing j clock signals to the second de-multiplexer 206 through j clock wirings CW2, the controller 202 may select one of the output terminals of the second de-multiplexer 206 to output the second data signal Din2, where j is an integer larger than 1. As shown in FIG. 4, the controller 202 provides clock signals CKH10-CKH12 to the second de-multiplexer 206 through 3 clock wirings CW2 to select one of the output terminals Out10-Out12 to output the first data signal Din2 to the data buses DB10-DB12.

Figure 5:
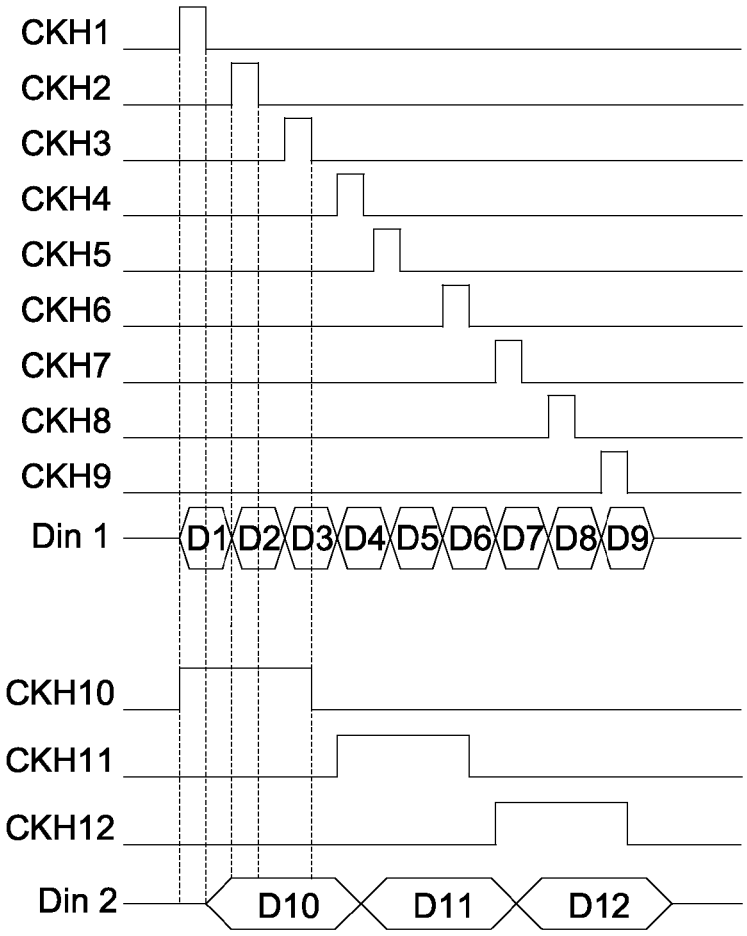
FIG. 5 is a timing sequence diagram of signals associated with the first and second de-multiplexers.

FIG. 5 illustrates a timing sequence diagram of signals associated with the first and second de-multiplexers 204 and 206. As shown is FIG. 5, when the clock signal CKH1 is rising, the data bus DB1, which is connected to the output terminal Out1 of the first de-multiplexer 204, begins to be charged to the data voltage D1. After the charging of the data bus DB1 is finished, the clock signal CKH1 is falling, and then the data voltage D1 is fixed to the data bus DB1. Likewise, when the clock signal CKH2 is rising, the data bus DB2, which is connected to the output terminal Out2 of the first de-multiplexer 204, begins to be charged to the data voltage D2. After the charging of the data bus DB2 is finished, the clock signal CKH2 is falling, and then the data voltage D2 is fixed to the data bus DB2.

Generally speaking, when the clock signals CKH1-9, CHK10-12 provided to the first and the second de-multiplexers 204 and 206 are rising, the data buses DB1-DB9 and DB10-DB12 connected to the first and second de-multiplexers 204 and 206 begin to be charged; when the clock signals CKH1-9 and CHK10-12 are falling, data voltages D1-D9 and D10-D12 on the data buses DB1-DB9 and DB10-DB12 are fixed.

Moreover, because it is found that the data buses DB1-DB9 with smaller data bus loads just needs less charging time than the data buses DB10-DB12 with larger data bus loads, the pulse width of the clock signals CKH1-CKH9 is shorter than the pulse width of the clock signals CKH10-CKH12, as shown in FIG. 5.

Figure 6:
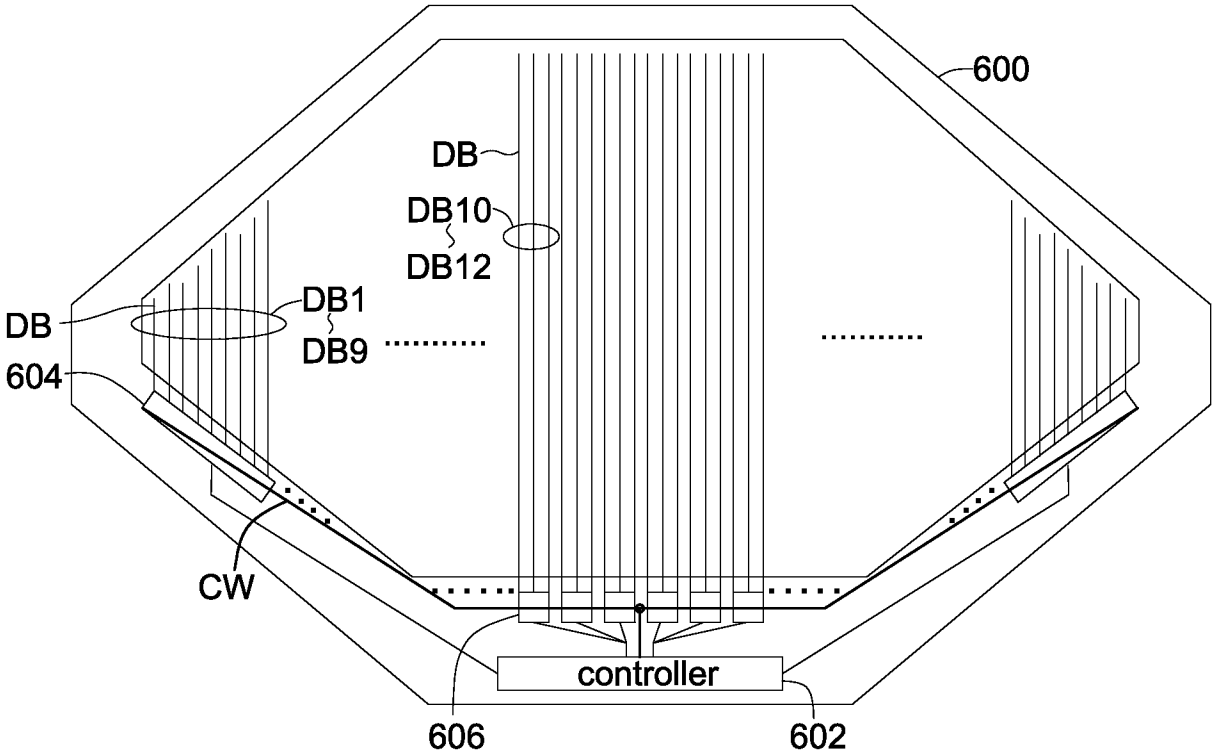
FIG. 6 is a schematic diagram of a display device according to another embodiment of the invention.

FIG. 6 is a schematic diagram of a display device 600 according to another embodiment of the invention. The display device 600 comprises a plurality of data buses DB, a controller 602, a first de-multiplexer 604, and a second de-multiplexer 606. The first de-multiplexer 604 has a de-multiplex ratio (which is equal to 9 in this example) that is larger than the de-multiplex ratio (which is equal to 3 in this example) of the second de-multiplexer 606. The main difference between the display device 600 and the display device 200 is that the clock wirings CW are co-used by the first and second de-multiplexers 604, 606. And, the circuit structure of the second de-multiplexer 606 is different from the previous embodiment.

Figure 7:
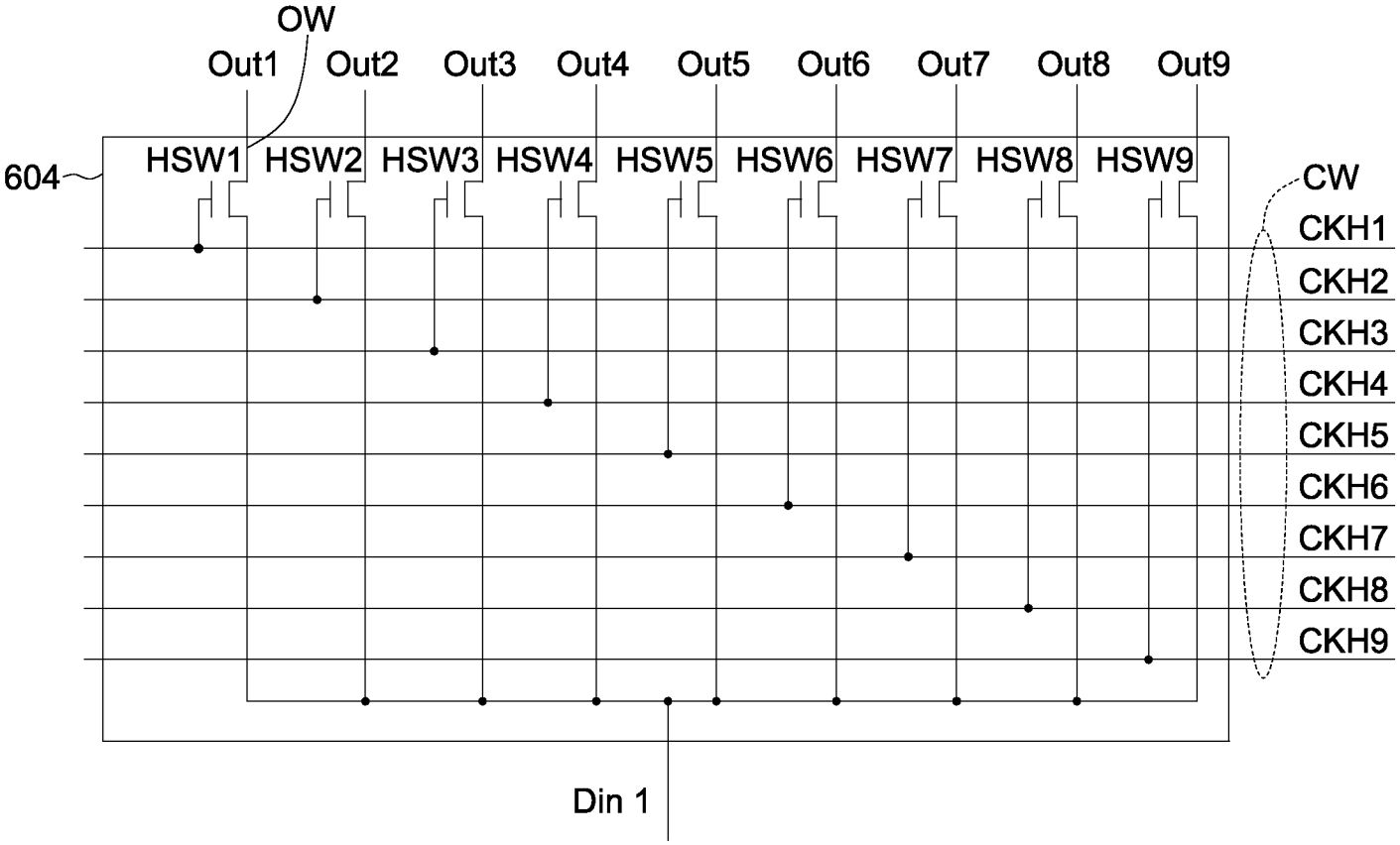
FIG. 7 is a circuit diagram of the first de-multiplexer.

FIG. 7 illustrates a circuit diagram of the first de-multiplexer 604. The first de-multiplexer 604 comprises 9 switching elements HSW1-HSW9 that each having an output wiring OW. The output wirings OW of the switching elements HSW1-HSW9 are respectively coupled to the output terminals Out1-Out9. In this example, the output terminals Out1-Out9 of the first de-multiplexer 604 are respectively coupled to the data buses DB1-DB9. By providing clock signals CKH1-CKH9 to the first de-multiplexer 604 through the co-used clock wirings CW, the controller 602 may select one of the output terminals Out1-Out9 to output the first data signal Din1 to the data buses DB1-DB9.

Figure 8:
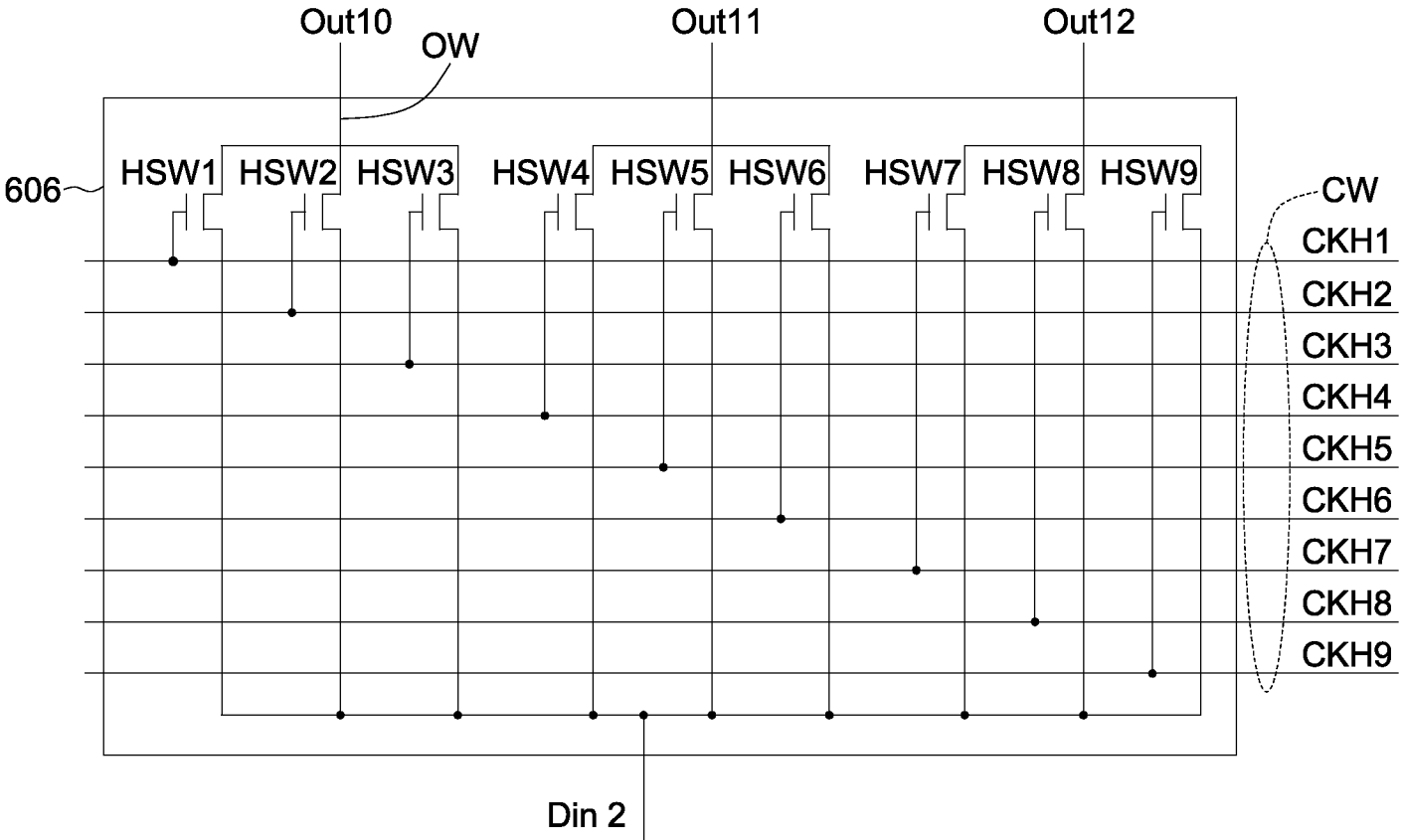
FIG. 8 is a circuit diagram of the second de-multiplexer.

FIG. 8 illustrates a circuit diagram of the second de-multiplexer 606. The second de-multiplexer 606 comprise 9 switching elements HSW1-HSW9 that each having an output wiring OW. Each L output wirings OW of the switching elements HSW1-HSW9 is combined into one of the output terminals Out10-Out12 of the second de-multiplexer 606 for outputting the second data signal Din2, where L is an integer. As shown in FIG. 8, 3 output wirings OW of the switching elements HSW1-HSW3 are gathered into the output terminal Out10; 3 output wirings OW of the switching elements HSW4-HSW6 are gathered into the output terminal Out11; and 3 output wirings OW of the switching elements HSW7-HSW9 are gathered into the output terminal Out12. In this example, the output terminals Out10-Out12 of the second de-multiplexer 606 are respectively coupled to the data buses DB10-DB12. By providing clock signals CKH1-CKH9 to the second de-multiplexer 606 through the co-used clock wirings CW, the controller 602 may select one of the output terminals Out10-Out12 to output the second data signal Din2 to the data buses DB10-DB12.

As shown in the above, the clock wirings CW are co-used in the first and second de-multiplexers 604 and 606, so the number of the clock wirings used in the display device 600 can be reduced (i.e. 3 clock wirings are reduced compared to the previous embodiment). Moreover, because the clock wirings CW are co-used by the first and second de-multiplexers 604 and 606, the clock signals CKH provided to both of the first and second de-multiplexers 604 and 606 can be controlled with the same timing, so that the synchronization between the first and second de-multiplexers 604 and 606 can be improved.

Figure 9:
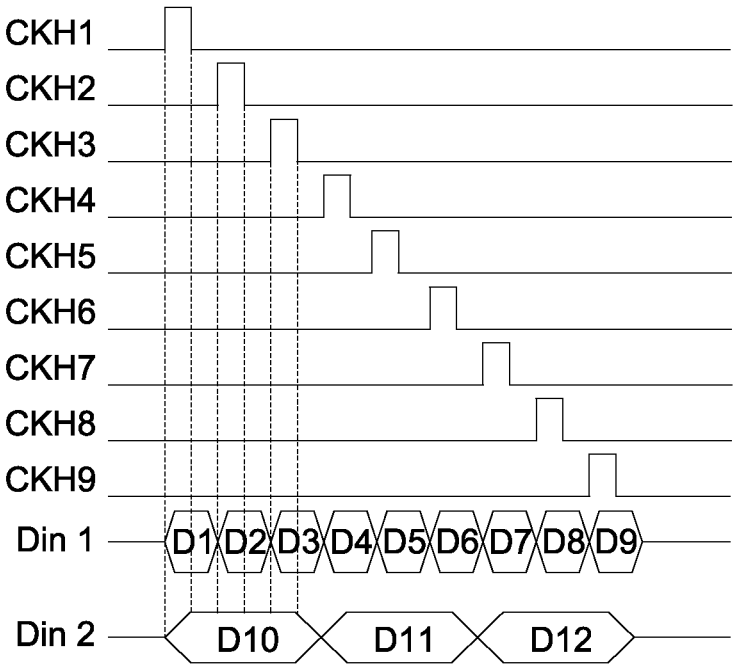
FIG. 9 is a timing sequence diagram of signals associated with the first and second de-multiplexers.

FIG. 9 illustrates a timing sequence diagram of signals associated with the first and second de-multiplexers 604 and 606. As shown in FIG. 9, by using the clock signals CKH1-CKH9, the data buses DB1-DB9 are respectively charged to and fixed to the data voltages Dl-D9. Also, the data bus DB10, which is coupled to the switching elements HSW1-HSW3, is charged by the clock signals CKH1-CKH3; the data bus DB11, which is coupled to the switching elements HSW4-HSW6, is charged by the clock signals CKH4-CKH6; and the data bus DB12, which is coupled to the switching elements HSW7-HSW9, is charged by the clock signals CKH7-CKH9.

Figure 10:
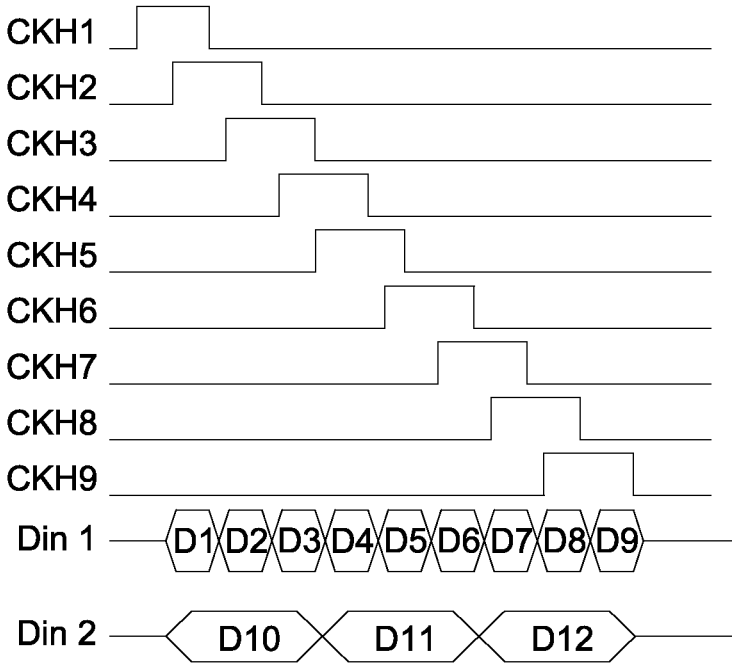
FIG. 10 is another example of the timing sequence diagram of the clock signals.

FIG. 10 illustrates another example of the timing sequence diagram of the clock signals CKH1-CKH9. As shown in FIG. 10, for each one of the clock signals CKH1-CKH9, the rising time of each is overlapped with the previous one. In other words, when the controller provides the clock signals sequentially, the rising time of the $k^{th}$ clock signal in time sequence is overlapped with the rising time of the $(k-1)^{th}$ clock signal in time sequence, where k is an integer larger than 1. Therefore, in this example, the charging time of the data buses DB can be extended, and the interval periods of the clock signals CKH1-CKH9 can be compensated. The clock signal CKH2 is rising at the same timing during the period that the clock signal CKH1 is in high state. So, the data voltage D1 is charged to the data bus DB2 (because the switching element HSW2 is turned on by the clock signal CKH2). At this time, the data voltage D1 is not fixed to the data bus DB2. Next, the data voltage D2, which is correct for the data bus DB2, is charged to the data bus DB2. After the charging of the data voltage D2 is finished, the clock signal CKH2 is falling, so that the data bus DB2 is fixed to the data voltage D2. By using the same charging operation, the data buses DB3 and DB9 are respectively charged to and fixed to correct data voltages D3 and D9.

Figure 11:
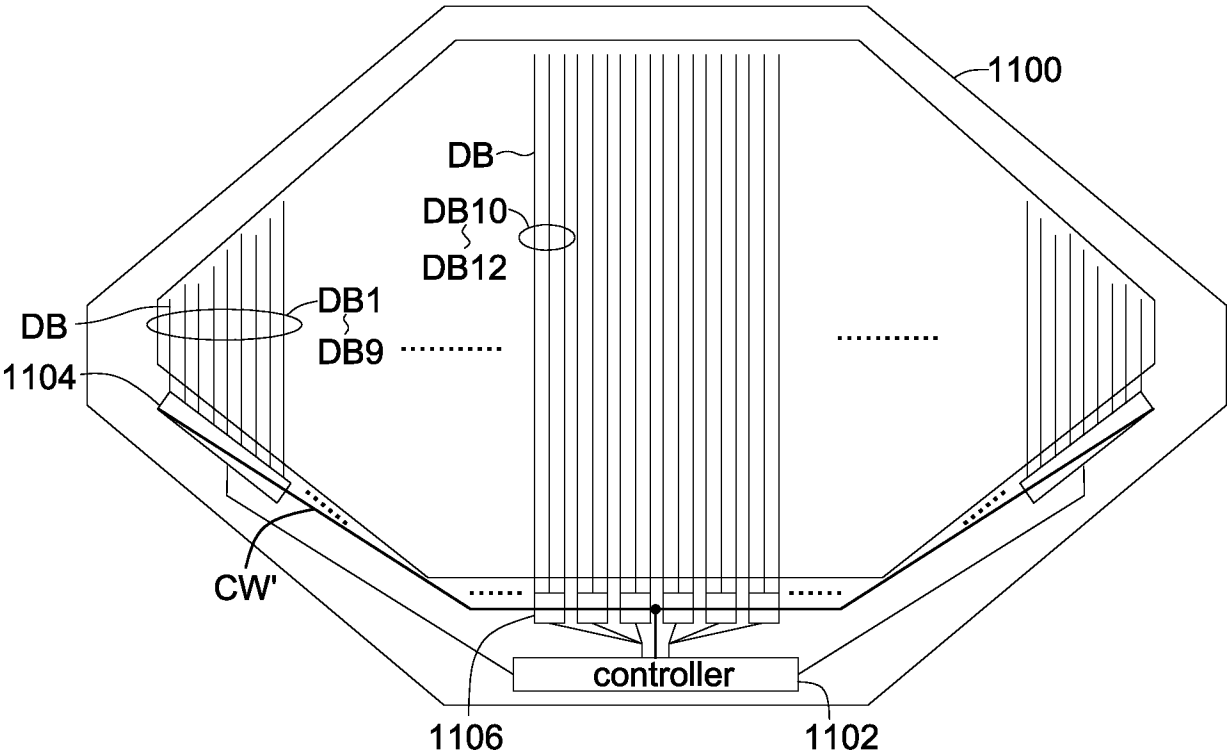
FIG. 11 is a schematic diagram of a display device according to another embodiment of the invention.

FIG. 11 illustrates a schematic diagram of a display device 1100 according to another embodiment of the invention. The display device 1100 comprises a plurality of data buses DB, a controller 1102, a first de-multiplexer 1104, and a second de-multiplexer 1106. Similar to the previous embodiment, the first de-multiplexer 1104 has a de-multiplex ratio (which is equal to 9 in this example) that is larger than the de-multiplex ratio (which is equal to 3 in this example) of the second de-multiplexer 1106. And, the clock wirings CW' are co-used by the first and second de-multiplexers 1104 and 1106. The main difference between the display device 1100 and the display device 600 is that the circuit structure of the second de-multiplexer 1106 is different from the second de-multiplexer 606 of the previous embodiment.

Figure 12:
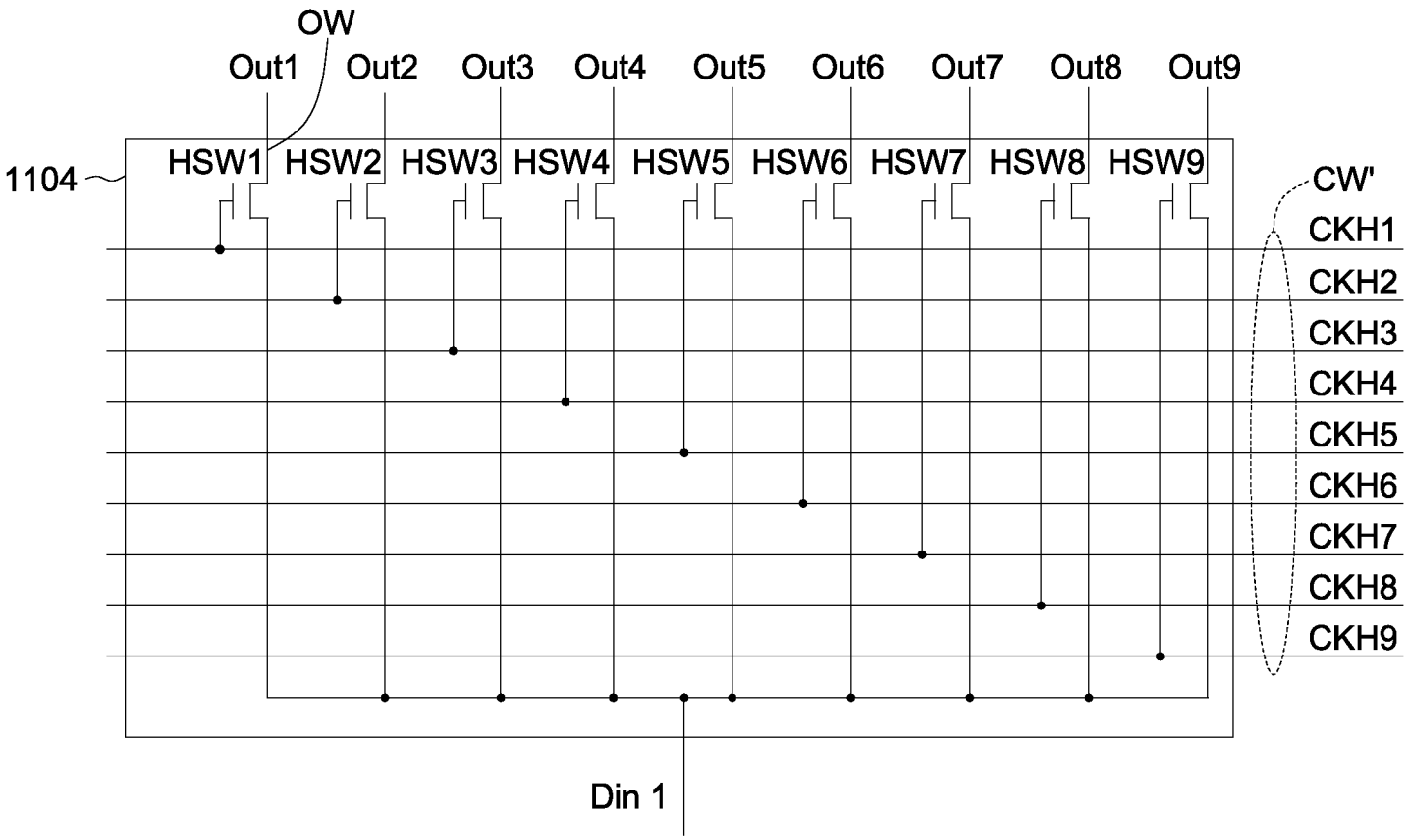
FIG. 12 is a circuit diagram of the first de-multiplexer.

FIG. 12 illustrates a circuit diagram of the first de-multiplexer 1104. The first de-multiplexer 1104 comprises 9 switching elements HSW1-HSW9 that each having an output wiring OW. The output wirings OW of the switching elements HSW1-HSW9 are respectively coupled to the output terminals Out1-Out9. In this example, the output terminals Out1-Out9 of the first de-multiplexer 1104 are respectively coupled to the data buses DB1-DB9. By providing clock signals CKH1-CKH9 to the first de-multiplexer 1104 through the co-used clock wirings CW', the controller 1102 may select one of the output terminals Out1-Out9 to output the first data signal Din1 to the data buses DB1-DB9.

Figure 13:
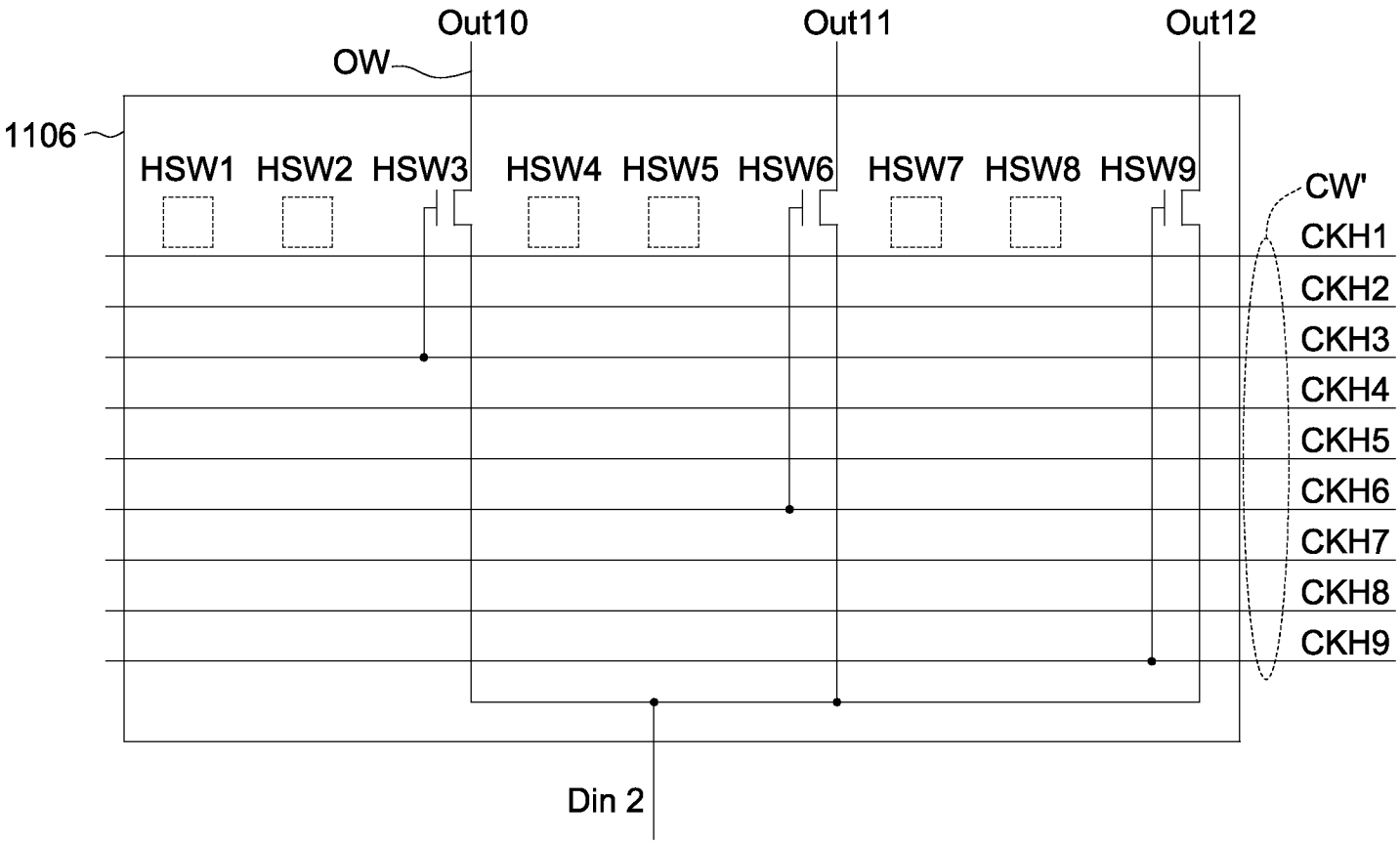
FIG. 13 is a circuit diagram of the second de-multiplexer.

FIG. 13 illustrates a circuit diagram of the second de-multiplexer 1106. The second de-multiplexer 1106 comprise 3 switching elements HSW3, HSW6 and HSW9 that each having an output wiring OW. The output wirings OW of the switching elements HSW3, HSW6, HSW9 are respectively coupled to the output terminals Out10-Out12. Each of the output terminals Out10-Out12 of the second de-multiplexer 1106 is coupled to a corresponding data bus DB. In this example, the output terminals Out10-Out12 are respectively coupled to the data buses DB10-DB12. By providing clock signals CKH1-CKH9 to the second de-multiplexer 1106 through the co-used clock wirings CW', the controller 1102 may select one of the output terminals Out10-Out12 to output the second data signal Din2 to the data buses DB10-DB12.

Compared to the previous embodiment, the second de-multiplexer 1106 omits the use of the switching elements HSW1, HSW2, HSW4, HSW5, HSW7 and HSW8. Therefore, the display device 1100 has advantage for simplifying the circuit layout of the second de-multiplexer 1106.

Figure 14:
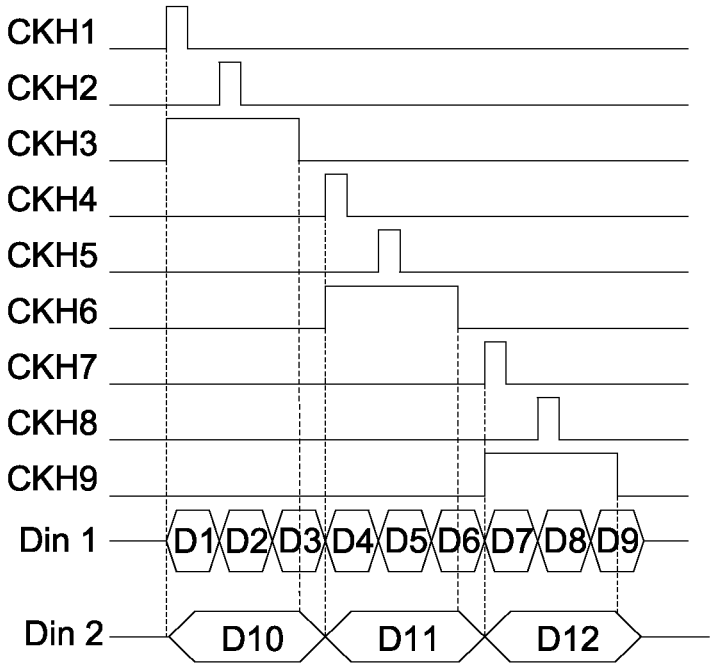
FIG. 14 is a timing sequence diagram of signals associated with the first and second de-multiplexers.

FIG. 14 illustrates a timing sequence diagram of signals associated with the first and second de-multiplexers 1104 and 1106. As shown in FIG. 14, the pulse width of the clock signals CKH3, CKH6, and CKH9, which are co-used in the first and second de-multiplexers 1104 and 1106, is larger than the pulse width of the clock signals CKH1, CKH2, CKH4, CKH5, CKH7 and CKH8, which are used only in the first de-multiplexer 1104. This is because the pulse width of the clock signals CKH3, CKH6, and CKH9 is corresponding to the charging period for the data buses DB10-DB12 that is with larger data bus load, and the pulse width of the clock signals CKH1, CKH2, CKH4, CKH5, CKH7 and CKH8 is corresponding to the charging period for the data buses DB1, DB2, DB4, DB5, DB7 and DB8 that is with smaller data bus load.

In this example, the charging operation of the data buses DB1, DB2, DB4, DB5, DB7 and DB8 is the same as the previous embodiment. The following is the illustration for the charging operation of the data buses DB3, DB6 and DB9. As shown in FIG. 14, the clock signal CKH3 is rising at the same timing of the clock signal CKH1. So, the data voltage D1 is charged to the data bus DB3 (because the switching element HSW3 is turned on by the clock signal CKH3). Then, during the period that the clock signal CKH2 is in high state, the clock signal CKH3 is also in high state, and the data voltage charged to the data bus DB3 is alternated from the data voltage D1 to the data voltage D2. At this time, the data voltage D2 is not fixed to the data bus DB3. Next, the data voltage D3, which is correct for the data bus DB3, is charged to the data bus DB3. After the charging of the data voltage D3 is finished, the clock signal CKH3 is falling, so that the data bus DB3 is fixed to the data voltage D3. By using the same charging operation, the data buses DB6 and DB9 are respectively charged to and fixed to correct data voltages D6 and D9.

Figure 15:
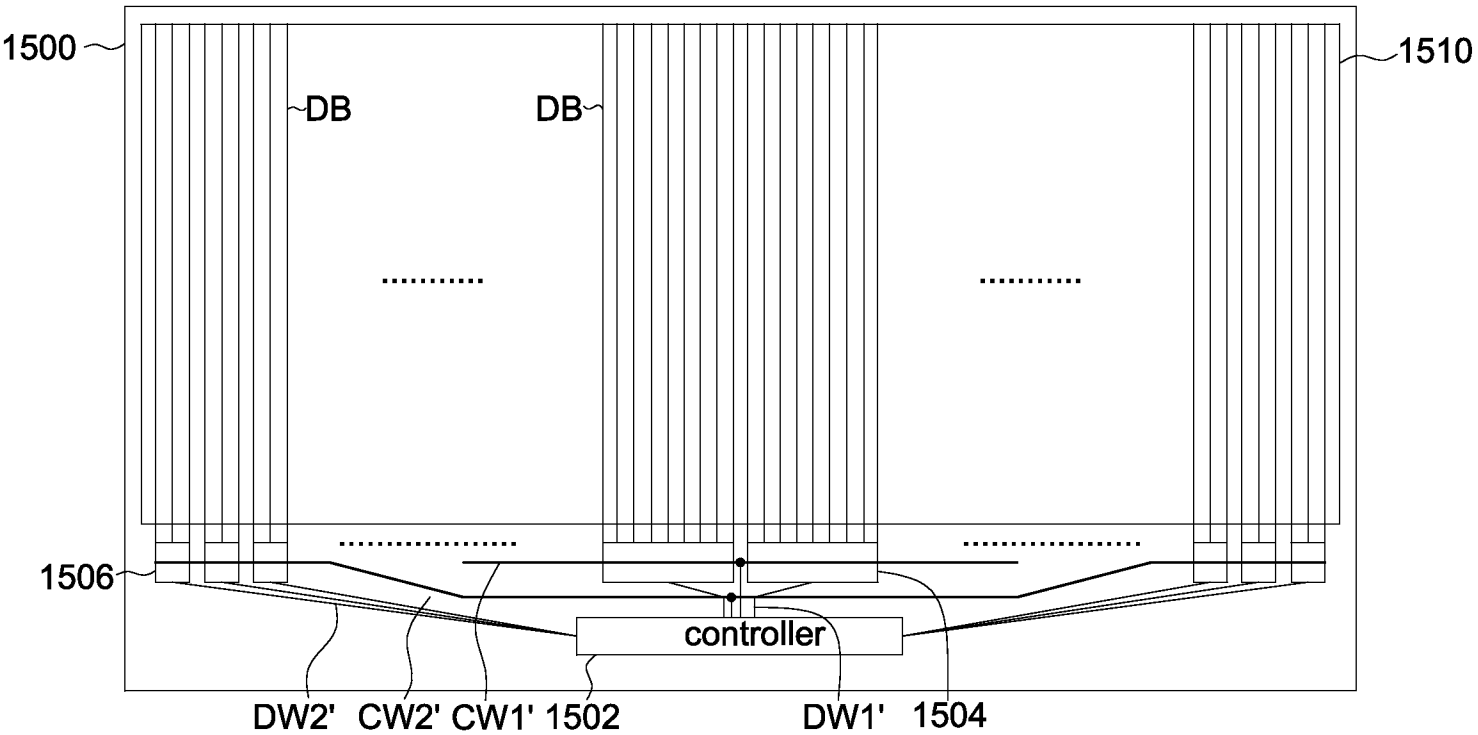
FIG. 15 is a schematic diagram of a display device according to another embodiment of the invention.

FIG. 15 illustrates a schematic diagram of a display device 1500 according to another embodiment of the invention. The display device 1500 comprises a plurality of data buses DB, a controller 1502, a first de-multiplexer 1504, and a second de-multiplexer 1506. The controller 1502 supplies clock signals to the first and second de-multiplexers 1504 and 1506 through the clock wirings CW1' and CW2' to control the first and second de-multiplexers 1504 and 1506, respectively. It can be understood that the invention is not limited to the above example. The clock wirings can be co-used by the first and second de-multiplexers 1504 and 1506 as described in the previous embodiment. The controller 1502 further provides the first and second data signals Din1 and Din2 to the first and second de-multiplexers 1504 and 1506 through a first data wiring DW1' having a first resistance and a second data wiring DW2' having a second resistance, respectively. The first and second resistance may be, for example, fan-out resistance.

The main difference between the display device 1500 and previous embodiments is that the first and second de-multiplexers 1504 and 1506 can be appropriately applied in the display device 1500 according to the resistance between the controller 1502 and the first and second de-multiplexers 1504 and 1506. In other words, in this example, de-multiplexers with larger de-multiplex ratio are applied to the data wirings having smaller resistance, and de-multiplexers with smaller de-multiplex ratio are applied to the data wirings having larger resistance. For example, if the length of the first data wiring DW1' is shorter than the second data wiring DW2', and/or the width of the first data wiring DW1' is broader than the second data wiring DW2', the first de-multiplexer 1504 with a first de-multiplex ratio that is larger than the second de-multiplex ratio of the second de-multiplexer 1506 is applied to the first data wiring DW1'.

Moreover, because the resistance differences between the controller 1502 and the de-multiplexers 1504 and 1506 exist in not only special shape but also in rectangular display, the display device 1500 is suitable for not only special shape but also for rectangular display. As shown in FIG. 15, even if the display area 1510 is rectangular and all the data buses DB have the same data bus load, the output number of the controller 1502 can be reduced by the above described configuration.

Based on the above, de-multiplexers with different de-multiplex ratio are applied in the display device of the present invention according to the data bus load of the data buses and/or the resistance between the controller and the de-multiplexers, so that the output number of controller can be significantly reduced.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A display device, comprising:

a display area;

a plurality of data buses located in the display area;

a controller for providing a first data signal and a second data signal;

a first de-multiplexer having a first de-multiplex ratio, for outputting the first data signal received from the controller to a plurality of first data buses of the data buses; and a second de-multiplexer having a second de-multiplex ratio, for outputting the second data signal received from the controller to a plurality of second data buses of the data buses;

wherein the first de-multiplex ratio is different from the second de-multiplex ratio.

2. The display device according to claim 1, wherein the first and second de-multiplexers are applied in the display device according to the data bus loads of the data buses.

3. The display device according to claim 2, wherein the first de-multiplex ratio is larger than the second de-multiplex ratio, and the data bus loads of the first data buses connected to the first de-multiplexer are less than the second data bus loads of the data buses connected to the second de-multiplexer.

4. The display device according to claim 3, wherein the lengths of the first data buses are shorter than the lengths of the second data buses.

5. The display device according to claim 2, wherein the first and second de-multiplexers comprise M and N output terminals connected to the data buses, respectively, the controller provides i clock signals to the first de-multiplexer through i clock wirings to select one of the M output terminals of the first de-multiplexer to output the first data signal to the first data bus, and provides j clock signals to the second de-multiplexer through j clock wirings to select one of the N output terminals of the second de-multiplexer to output the second data signal to the second data bus, where M, N, i and j are integers larger than 1, and N is less than M.

6. The display device according to claim 5, wherein the controller provides the i clock signals to the first de-multiplexer sequentially, the rising time of a $k^{th}$ clock signal of the i clock signals in time sequence is overlapped with the rising time of a $(k-1)^{th}$ clock signal of the i clock signals in time sequence, where k is an integer larger than 1.

7. The display device according to claim 5, wherein the first de-multiplexer further comprises M switching elements that each have an output wiring, the output wirings of the M switching elements are respectively coupled to the M output terminals of the first de-multiplexer; the second de-multiplexer further comprises N switching elements that each having an output wiring, the output wirings of the N switching elements are respectively coupled to the N output terminals of the second de-multiplexer.

8. The display device according to claim 7, wherein the pulse width of the i clock signals provided to the first de-multiplexer is shorter than the pulse width of the j clock signals provided to the second de-multiplexer.

9. The display device according to claim 5, wherein the clock wirings are co-used by the first and second de-multiplexers, so that the i clock signals provided to the first de-multiplexer are the same as the j clock signals provided to the second de-multiplexer, where i is equal to j.

10. The display device according to claim 9, wherein the first de-multiplexer further comprises M switching elements that each having an output wiring, the output wirings of the M switching elements are respectively coupled to the M output terminals of the first de-multiplexer; the second de-multiplexer further comprise M switching elements that each having an output wiring, each L of the output wirings of the M switching elements of the second de-multiplexer is combined into one of the N output terminals of the second de-multiplexer, where L is an integer less than M.

11. The display device according to claim 9, wherein the first de-multiplexer further comprises M switching elements that each having an output wiring, the output wirings of the M switching elements are respectively coupled to the M output terminals of the first de-multiplexer; the second de-multiplexer further comprise N switching elements that each having an output wiring, the output wirings of the N switching elements are respectively coupled to the N output terminals of the second de-multiplexer.

12. The display device according to claim 11, wherein the M switching elements of the first de-multiplexer are controlled by the i clock signals, and the N switching elements of the second de-multiplexer are controlled by N clock signals of the i clock signals, the N clock signals of the i clock signals are co-used in the first and second de-multiplexers.

13. The display device according to claim 12, wherein the pulse width of the clock signals used only in the first de-multiplexer is shorter than the pulse width of the clock signals co-used in the first and second de-multiplexers.

14. The display device according to claim 1, wherein the first de-multiplexer ratio is larger than the second de-multiplexer ratio, and the controller provides the first and second data signals to the first and second de-multiplexers through a first data wiring and a second data wiring, respectively;

wherein the first and second data wirings have a first resistance and a second resistance, respectively, and the first resistance is less than the second resistance.

15. The display device according to claim 1, wherein the display area is formed in a shape consisting of circle, shell, semicircle, oval, triangle, rhombus, trapezoid, polygon, and any combinations thereof.

16. The display device according to claim 1, wherein the display device further comprises a third de-multiplexer for outputting a third data signal received from the controller to a third data bus of the data buses, wherein the third de-multiplexer has a third de-multiplex ratio which is larger than the second de-multiplex ratio and smaller than the first de-multiplex ratio.

17. The display device according to claim 16, wherein the display device further comprises a border area adjacent to the display area, the border area is divided into a side edge area for disposing the first de-multiplexer, a middle area for disposing the second de-multiplexer, and an intermediate area for disposing the third de-multiplexer, wherein the intermediate area is located between the middle and side edge area.

18. The display device according to claim 1, wherein the display area further comprises a border area adjacent to the display area, the border area is divided into a side edge area for disposing the first de-multiplexer, a middle area for disposing the second de-multiplexer, and an intermediate area for disposing a de-multiplexer combination of the first and second de-multiplexers, wherein the intermediate area is located between the middle and side edge area.

19. The display device according to claim 18, wherein the de-multiplexer combination comprises:

a first de-multiplexer combination having a first combination ratio; and a second de-multiplexer combination having a second combination ratio, wherein the first de-multiplexer combination is disposed between the second de-multiplexer combination and the first de-multiplexer.

wherein the combination ratio is the quantity of the first de-multiplexer to the quantity of the second de-multiplexer, and the first combination ratio is larger than the second combination ratio.

20. The display device according to claim 19, wherein the combination ratio in the intermediate area is increasing from an area adjacent to the middle area to another area adjacent to the side edge area.

* * * * *